United States Patent [19]

Mikuni et al.

[11] Patent Number: 4,690,080

[45] Date of Patent: Sep. 1, 1987

[54] OVEREDGE SEWING MACHINE

[75] Inventors: Yoshio Mikuni, Osaka; Osamu Koshinaka, Izumi, both of Japan

[73] Assignee: Maruzen Sewing Machine Co., Ltd., Osaka, Japan

[21] Appl. No.: 885,698

[22] Filed: Jul. 15, 1986

[30] Foreign Application Priority Data

Jul. 15, 1985 [JP] Japan ..... 60-156826

[51] Int. Cl.[4] ..... D05B 1/20; D05B 57/06

[52] U.S. Cl. ..... 112/162; 112/168; 112/200

[58] Field of Search ..... 112/162, 168, 166, 200

[56] References Cited

U.S. PATENT DOCUMENTS

| | | | |
|---|---|---|---|
| 4,220,102 | 9/1980 | Draghiccio et al. | 112/200 |
| 4,237,804 | 12/1980 | Hirayama | 112/168 |
| 4,463,696 | 8/1984 | Steckenrider | 112/200 |

*Primary Examiner*—Wm. Carter Reynolds

*Attorney, Agent, or Firm*—Lowe Price LeBlanc Becker & Shur

[57] ABSTRACT

An overedge sewing machine is adapted to perform three thread overedge stitching (STITCH TYPES 504 and 505) under the cooperating action of one needle (6) and an upper looper (15) and a lower looper (31). In addition to swing movement in the direction crossing the fabric feed direction, reciprocating movement in the fabric feed direction is selectively applied to the lower looper, whereby the front end of the lower looper is revolved around the needle. If the lower looper is revolved around the needle with the upper looper out of action, this operation provides double chain stitching (STITCH TYPE 401). Further, if the lower looper is revolved around the needle with the upper looper in action, this operation provides three thread double chain overedge stitching (STITCH TYPE 601).

16 Claims, 31 Drawing Figures

Fig. 6.
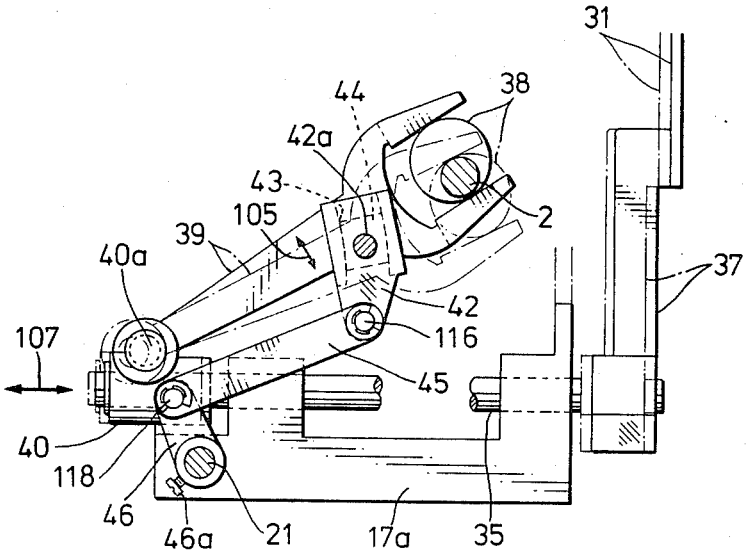
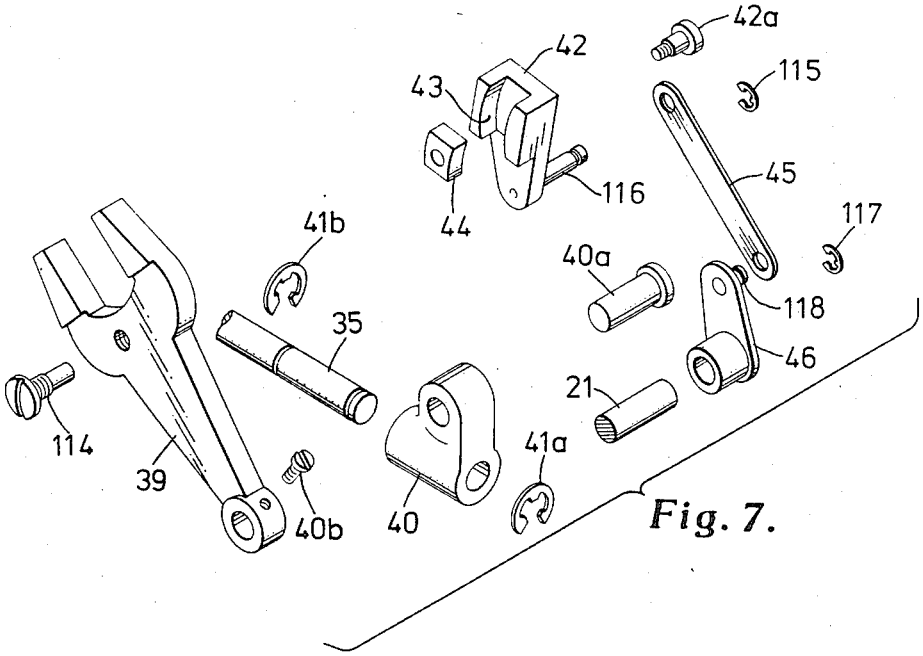
Fig. 7.

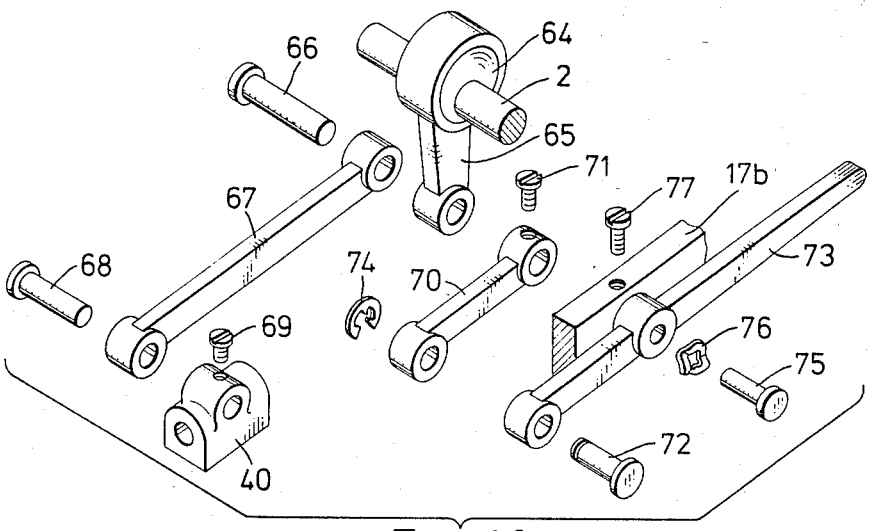
Fig. 16.
Fig. 17.
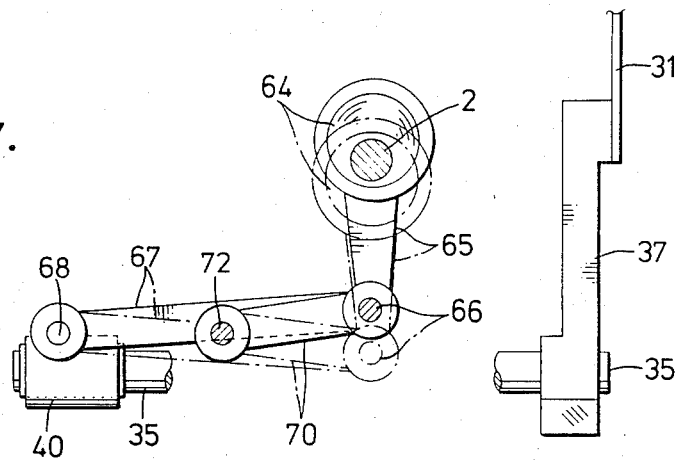
Fig. 18.
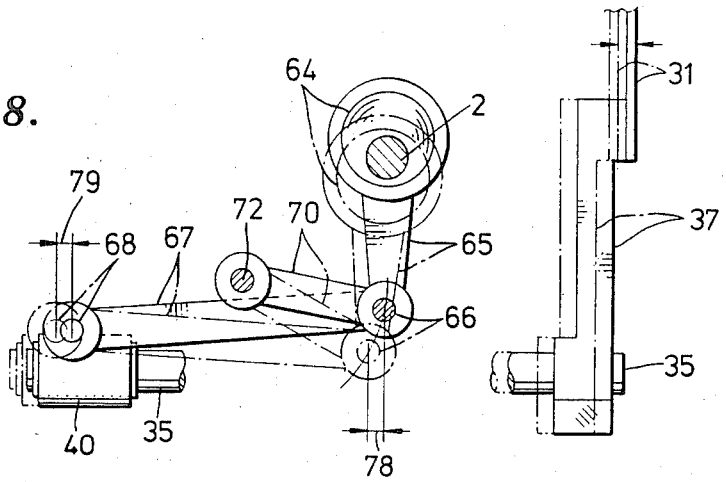

OVEREDGE SEWING MACHINE

BACKGROUND OF THE INVENTION

1. Field of the Invention

This invention relates to improvements in an overedge sewing machine and more particularly it relates to an overedge sewing machine which is also capable of forming chain stitches without overedge stitches.

2. Description of the Prior Art

In recent years, for the sewing of clothes in homes, or the so-called home-sewing, overedge stitching has become popular among home sewers for them to show their originality or to improve their works. The following types of overedge sewing machines are frequently used for overedge stitching:

(1) The so-called three thread overedge sewing machine having the combined function of seaming and overedging in one that is simultaneously join together and finishing the raw edges of two pieces of fabric (USA FEDERAL STANDARD 751a STITCH TYPES 504 and 505); and (2) The two thread overedge sewing machine which has only the function of overedging, not being capable of seaming (USA FEDERAL STANDARD 751a STITCH TYPES 502 and 503).

However, such overedge sewing machines, which form overedge stitches, cannot be used for the sole purpose of seaming or joining together; in such cases, for, a sewing operation it is necessary to also a straight stitch forming machine or a double thread chain stitch forming machine, i.e., at least two sewing machines are required for sewing that includes formation of overedge stitches.

Every home sewer cannot afford to possess such two sewing machines, which probably accounts for the fact that overedge stitching has not become widespread in home sewing.

The applicant (assignee) proposed an arrangement wherein, as in Japanese Utility Model Publication Nos. 33983/1983 and 36397/1983, in another type of overedge sewing machine which makes a "true safety stitch" (four threads) with two separate seams—an ordinary two thread overedge stitch and a double thread chain stitch (USA FEDERAL STANDARD 751a STITCH TYPE 515) a double chain stitch forming mechanism is made switchable to the overedge stitch forming mechanism, thus enabling a single sewing machine to form both the overedge stitches for finishing the raw edges and the double chain stitches for seaming two pieces of fabric.

However, although such seaming two pieces of fabric by double thread chain stitches has become possible, three thread overedge stitching, rather than the overedge stitching by the said two thread overedge sewing machine and four thread overedge sewing machine, is used in joining sleeves and closing sides of clothes such as shirts, blouses etc.

Further, three thread overedge stitching, as compared with two thread or four thread overedge stitching, functionally has many applications, such as narrow/rolled hems ideal for use on thin materials such as Crepe de Chine, Silk etc., blind hem used for hemming on trousers or skirts, and pin tucks used for ornament, and, externally it is beautiful because of stitches formed of three threads. For this reason, three thread overedge stitching has been exclusively used in home sewing.

However, there is no three thread overedge sewing machine available which is capable of seaming two pieces of fabric without overedge stitching.

SUMMARY OF THE INVENTION

With the above in mind, an object of the invention is to provide a sewing machine having both functions of both overedge stitching (which has aforesaid advantage) and double thread chain stitching for seaming two pieces of fabric.

To achieve the aforesaid object, this invention provides a dual purpose overedge sewing machine, wherein three thread overedge stitches are formed by cooperation between one needle and upper and lower loopers, the overedge sewing machine including elements for canceling the operative connection between the upper looper and the main shaft, and elements by which a swing shaft having the lower looper fixed thereon is reciprocated in the fabric feed direction, as by a cooperative connection to the main shaft with the timing agreeing with the vertical movement of said needle.

In a preferred embodiment of the invention, this sewing machine has means for inactivating the reciprocating means.

According to the overedge sewing machine thus constructed, with threads passed through the needle and the upper and the lower loopers, the upper and the lower loopers are operatively connected to the main shaft and moved in the direction which crosses the fabric feed direction, and the conventional three thread overedge stitching is then performed (USA FEDERAL STANDARD 751a STITCH TYPES 504 and 505).

Also, if threads are passed through the needle and lower looper and the operative connection of the upper looper to the main shaft is cancelled and the lower looper is caused to perform the combined movement, in the fabric feed direction and in the direction crossing the fabric feed direction, then the double chain stitching is performed (USA FEDERAL STANDARD 751a STITCH TYPE 401).

Furthermore, if threads are passed through the needle and the upper and lower loopers and the upper looper is operatively connected to the main shaft and the lower looper is caused to perform the combined movement, in the fabric feed direction and in the direction crossing the fabric feed direction, then conventional stitches are performed STITCH TYPE 601 classified in USA FEDERAL STANDARD 751a.

In addition, in each of the three types of operations, the thread tension will be suitably adjusted.

BRIEF DESCRIPTION OF THE DRAWINGS

FIG. 6 is a view similar to FIG. 5 but showing the parts in a different usage mode;

FIG. 7 is an exploded perspective view of the parts constituting the portion shown in FIG. 5;

FIG. 16 is an exploded perspective view of the parts constituting the portion shown in FIG. 15; and FIGS. 17 and 18 are views for explaining the function of the mechanism shown in FIG. 15, showing different usage modes.

DESCRIPTION OF THE PREFERRED EMBODIMENTS

Preferred ebodiments of the invention will now be described with reference to the accompanying drawings.

Figure 1:
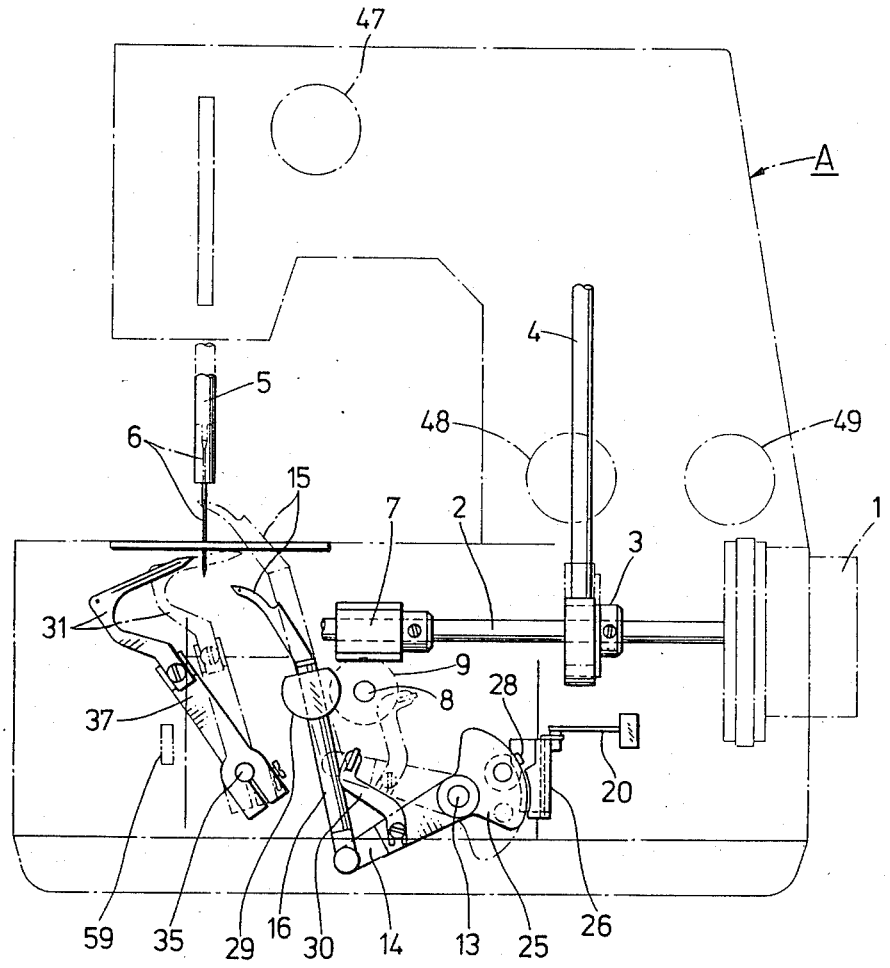
FIG. 1 is a schematic front view of the internal mechanism of an overedge sewing machine according to a preferred embodiment of the invention.

An overedge sewing machine shown in FIG. 1, like a conventional three thread overedge sewing machine for USA FEDERAL STANDARD 751a STITCH TYPES 504 and 505 such as one shown in U.S. Pat. No. 2,218,796, is arranged so that a longitudinally extending main shaft 2 is driven by a motor 1, the rotation of the main shaft 2 being transmitted through a cam 3 and a connecting rod 4 to a needle bar 5, so that a needle 6 is vertically moved with the required timing.

A drive gear 7, e.g., a spiral gear, on the main shaft 2 meshes with a spiral gear 9 on a horizontal shaft 8 supported by a sewing machine body A, as shown in FIG. 1, said shaft also carrying an upper looper driving rod 11 through a cam 10, so that with the rotation of the main shaft 2 the cam 10 is rotated through the gears 7 and 9 and shaft 8 and the upper looper driving rod 11 loosely fitted on the cam 10 is swung as indicated by arrows 101. Operatively connected to the driving rod 11 through an arm 12 is a horizontal shaft 13 supported by the body A, so that when the driving rod 11 is swung, the shaft 13 is repeatedly rotated through a predetermined angle by the arm 12. The arrangement described above is a known mechanism.

Figure 2:
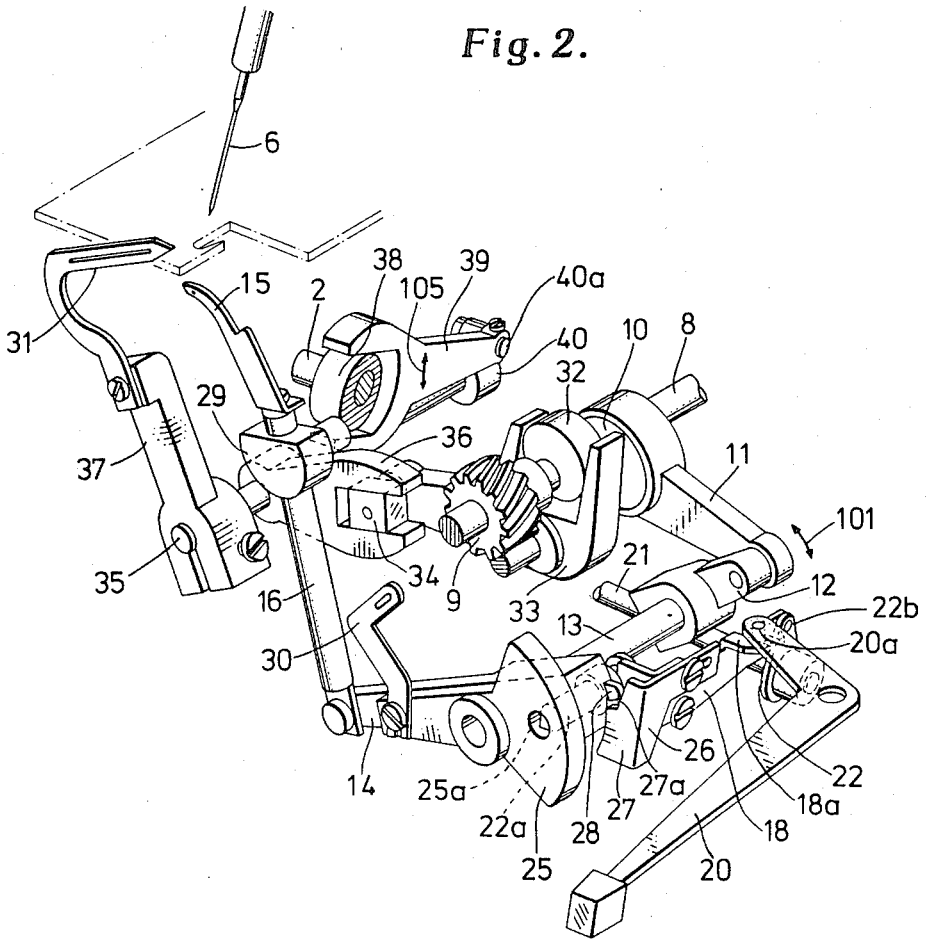
FIG. 2 is a perspective view of the principal portion of the internal mechanism of the sewing machine shown in FIG. 1.
Figure 4:
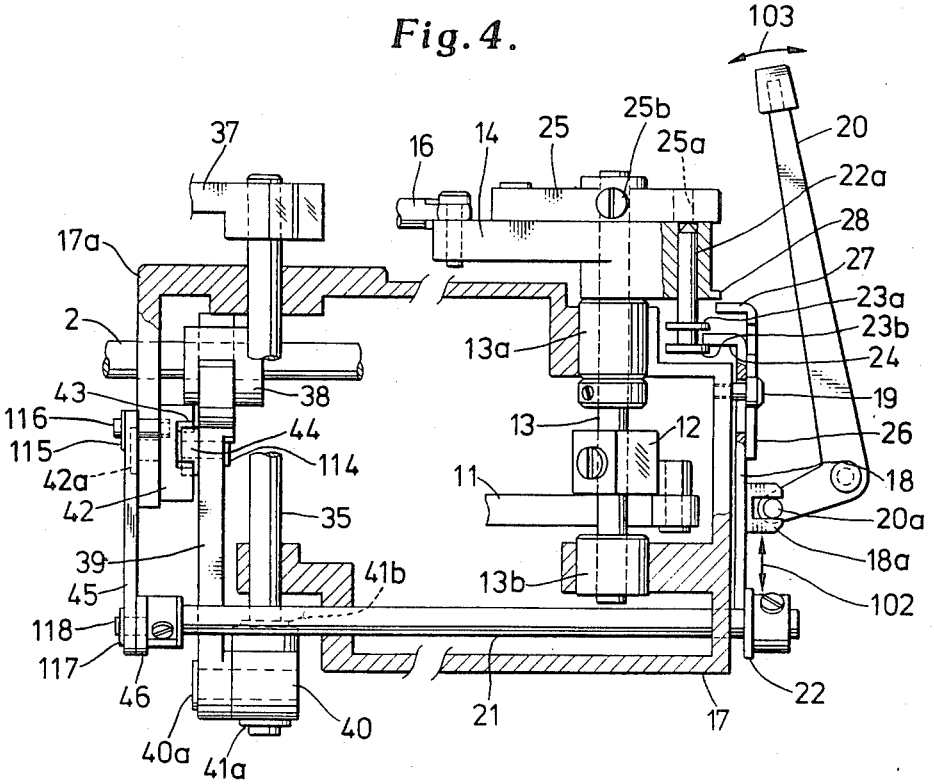
FIG. 4 is a bottom view of the portion shown in FIG. 2.

The aforesaid shaft 13, as shown in FIGS. 2 and 4, has a swing member 14 rotatably fitted thereon for rotation around the axis of the shaft 13, said swing member 14 having connected to the left-hand side end thereof a lifting rod 16 having an upper looper 15. The right-hand side surface of the body A supporting the shaft 13 through a bearing 13*a* has an operating plate 18 attached thereto through a pin 19 so that it is movable in the transverse direction, i.e., in the directions of arrows 102, said plate 18 having a bifurcated portion 18*a* which is connected to the active end of an L-shaped operating lever 20 through a pin 20*a*; thus, moving the operating lever 20 as indicated by arrows 103 in FIG. 4 causes the pin 20*a* and bifurcated portion 18*a* to move the operating plate 18 in the transverse direction. The rear end of the operating plate 18 is connected through a pin 22*b* to an arm 22 on a longitudinally extending operating shaft 21 disposed at the rear edge of the frame 17, so that transverse movement of the operating plate 18 causes the operating shaft 21 to be repeatedly rotated through a required angle.

The front end of the operating plate 18 is bent to the left, facing to a locking pin 22*a* inserted in said swing member 14. As shown in FIG. 4, the rear end of the locking pin 22*a* has spaced stop rings 23*a* and 23*b* fixed thereon, with the bent portion 24 of said operating plate 18 disposed between said rings 23*a* and 23*b*. Therefore, when the operating plate 18 is transversely moved, the locking pin 22*a* is transversely moved to enter or leave a hole 25*a* formed in a connecting member 25 fixed to said shaft 13 by a screw 25*b*, the fitting of said pin 22 in said hole 25 uniting the two members 25 and 14 to cause the upper looper 14 to act. In FIG. 1, the positions of the upper looper 15 shown in solid and phantom lines correspond to the terminal ends of the range of movement of the upper looper 15.

In addition, to prevent cancellation of the locked relationship between the pin 22 and the bent portion 24 even when the members 25 and 14 are swung, the width (or vertical dimension as seen in FIG. 2) of the bent portion 24 is suitably determined. Further, the right-hand side surface of the operating plate 18 has a malfunction preventing plate 26 fixed thereon, the arrangement being such that, as shown in FIG. 2, the forward movement of the operating plate 18 is allowed only when a notch 27*a* formed in the front bent portion 27 of said plate 26 is aligned with a projection 28 on the swing member 14. That is, as shown in FIG. 2, only when the upper looper 15 is in its lowermost position is the locking pin 22*a* allowed to enter the hole 25*a*; thus, with the upper looper 15 assuming any other position, the movement of the upper looper 15 due to careless operation on the operating lever 20 is prevented. In addition, when the upper looper 15 is in its lowermost position, it assumes the solid line position shown in FIG. 1, not projecting above the bed of the sewing machine.

Figure 9A:
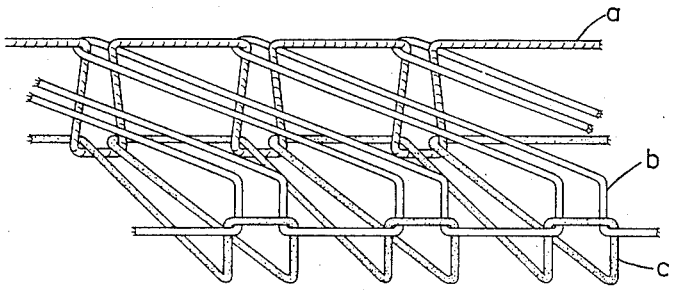
FIGS. 9A and 9B shows two examples of three thread overedge stitching (STITCH TYPES 504 and 505, respectively)

The lifting rod 16 of the upper looper 15 extends through a bearing 29 rotatably supported by the body A, so that when the swing member 14 is swung around the axis of the shaft 13, the lifting rod 16 is vertically moved while rotating around the axis of the bearing 29, thereby imparting the required timed movement to the upper looper 15. A thread b (for example, per FIG. 9A) is led from a thread guide 30 on the connecting member 25 to the upper looper 15.

Figure 3:
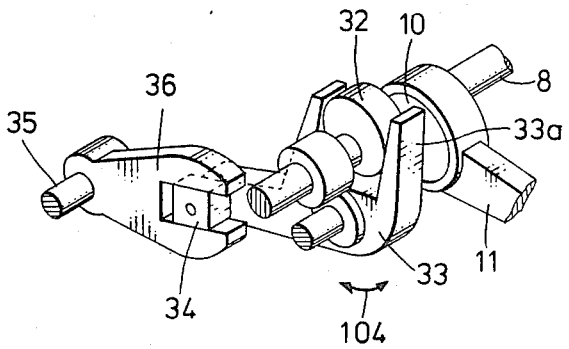
FIG. 3 is a perspective view of a portion extracted from FIG. 1.

The above refers to the driving mechanism for the upper looper 15. The driving mechanism for the lower looper 31 will now be described. As shown in FIG. 3, a cam 32 on the shaft 8 rotated by the main shaft 2 is engaged with the bifurcated portion 33*a* of an L-shaped member 33 rotatably supported by the body A, so that when the cam 32 is rotated, the member 33 is swung, as indicated by arrows 104. Rotatably supported on the left-hand side end of the member 33 through a projecting shaft is a square block 34 which is longitudinally movably held in a bifurcated member 36 fixed on the shaft 35 of the lower looper 31, so that when the member 33 is swung, the shaft 35 is repeatedly rotated through a required angle through the block 34 and bifurcated member 36. This repeated rotation causes the swing movement of a lower looper block 37 fixed on the shaft 35, so that the lower looper 31 is longitudinally swung with the required timing. In addition, the shaft 35 is transversely moved as will be later described; thus, the widths (or transverse dimensions as seen in FIG. 3) of the bifurcation and square block 34 are determined so that the square block 34 will not be disengaged from the bifurcation when the member 36 is transversely moved.

Figure 5:
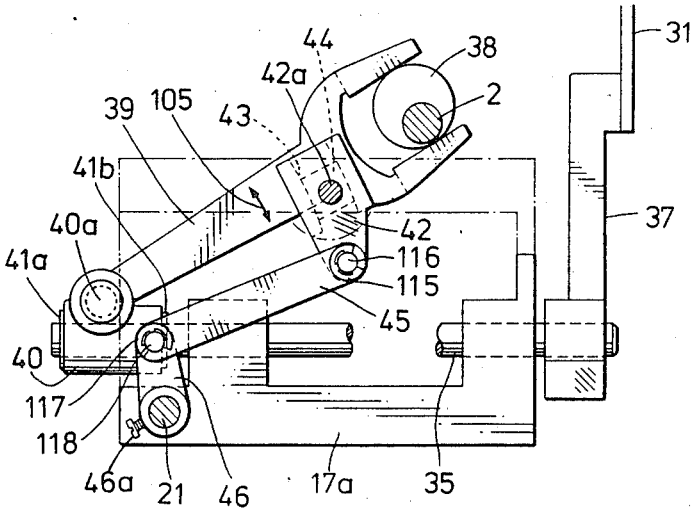
FIG. 5 is a view showing a bifurcated member and other parts extracted from the left-hand side of FIG. 2.

The left-hand side end of the main shaft 2, as shown in FIGS. 2, 5 and 6, has a cam 38 fixed thereon, and a bifurcated member 39 is fitted on said cam 38, so that the rotation of the main shaft 2 causes the cam 38 to swing the bifurcated member 39, as indicated by arrows 105. The proximal end of the bifurcated member 39, as shown also in FIG. 7, is rotatably supported on a pin 40*a* in a bearing 40 rotatably fitted on said lower looper shaft 35, axial movement of said bearing 40 being prevented by slip-off preventive elements such as E-rings 41*a* and 41*b*. That is, the bifurcated member 39 is rotatable relative to the shaft 35 but is not axially movable relative to the shaft 35. The pin 40*a* is fixed to the bifurcated member 39 by a screw 40*b*.

Figure 8A:
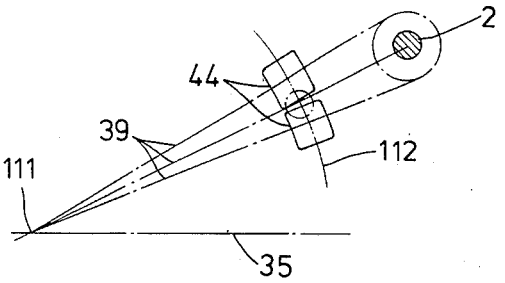
FIG. 8A is a view for explaining the function performed in the state shown in FIG. 5.

The lower looper shaft 35 is rotatably and axially movably supported by the frame 17*a* of the sewing machine body A, and said frame 17*a* is provided with a guide member 42 shown in FIG. 7 so that the guide member 42 is rotatable around the axis of a screw or pin 42*a*. The right-hand side surface of said member 42 is formed with a groove 43 which extends with the same curvature as that of a circle whose radius is equal to the distance from the center of swing movement of the bifurcated member 39 to the pin 42*a*. Fitted in the groove 43 is a square block 44 installed on the bifurcated member 39 through a pin 114. As shown in FIG. 8A, corresponding to FIG. 5, when the groove extends along an arc 112 whose center is the center 111 of swing movement of the bifurcated member 39, then, even if the bifurcated member 39 is swung, the square block 44 simply slides in the groove 43 extending in the direction of the arc 112 and does not impart any longitudinal force to the center 111 of swing movement. On the other hand, as shown in FIG. 6, when the guide member 42 is tilted and the groove 43 extends along an arc 113 shown in FIG. 8B and hence does not extend along the arc 112 whose center is said center 111 of swing movement, then, as the square block 44 slides, the center 111 of swing movement is moved over a range 111 (FIG. 8B) in the direction of arrows 107 (FIG. 6), whereby the lower looper shaft 35 is transversely moved. This transverse movement is associated with the timing for chain stitching which will be later described.

Figure 8B:
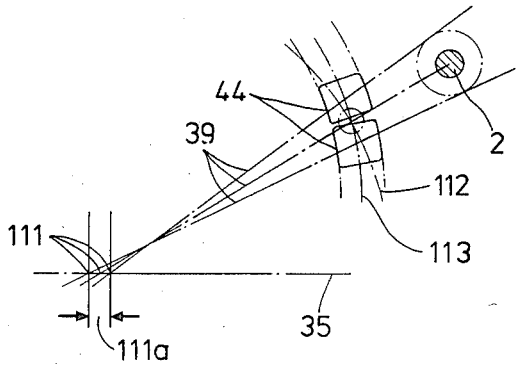
FIG. 8B is a view for explaining the function performed in the state shown in FIG. 6.

The lower end of guide member 42 is turnably connected to one end of a connecting rod 45 through a pin 116 while applying a slip-off preventive element 115, and the other end of the connecting rod 45 is connected to a rod 46, which is fixed to the left-hand side end of said operating shaft 21 by a screw 46*a*, through a pin 118 while applying a slip-off preventive element 117; thus, by turning of the operating shaft 21, the guide member 42 is switched between the state of FIG. 8A and the state of FIG. 8B. That is , as shown in FIG. 4, the connecting member 25 and the swing member 14 are connected together by said operating lever 20, so that in the case where the upper looper 15 is to be moved, the member 42 is positioned, as shown in FIGS. 5 and 8A, whereby force only from the bifurcated member 36 is imparted to the shaft 35, thereby only longitudinally moving the lower looper 31, so that sewing by cooperation between the needle 6 and the upper and lower loopers 15 and 31 is performed. Further, in the case where the connection between the connecting member 25 and the swing member 14 is canceled by the operating lever 20, the member 42 is positioned as shown in FIGS. 6 and 8B, so that forces from the bifurcated members 36 and 39 are imparted to the shaft 35, thereby longitudinally and transversely moving the lower looper 31, so that sewing by cooperation between the needle 6 and the lower looper 31 is performed.

In addition, the numerals 47, 48 and 49 shown in FIG. 1 denote thread tension regulators for the needle thread a and upper and lower looper threads b and c, only the positions of said tension regulators being shown in FIG. 1. The tension regulators 47, 48 and 49 provide thread tensions necessary for the sewing operations to be later described.

The embodiment is arranged in the manner described above, and its function will now be described.

Figure 9B:
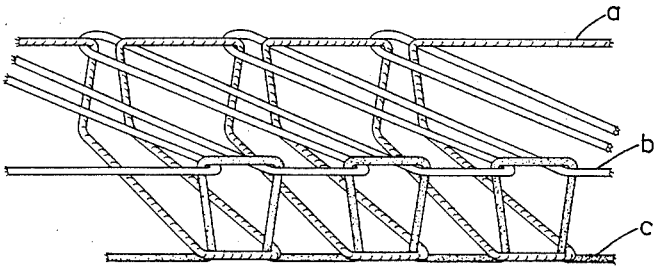

First, the threads a, b and c are passed through the needle 6 and the upper and lower loopers 15 and 31, respectively, and the upper looper 15 is operatively connected to the main shaft 2 by the operating lever 20, while the lower looper 31 is only swung (longitudinally). When sewing is performed under this condition, three thread overedge stitching (USA FEDERAL STANDARD 751a STITCH TYPE 504) shown in FIG. 9A or three thread hem overedge stitching (USA FEDERAL STANDARD 751a STITCH TYPE 505) shown in FIG. 9B is attained. The selection of these sewing modes depends on the adjustment of each thread tension.

Figure 11:
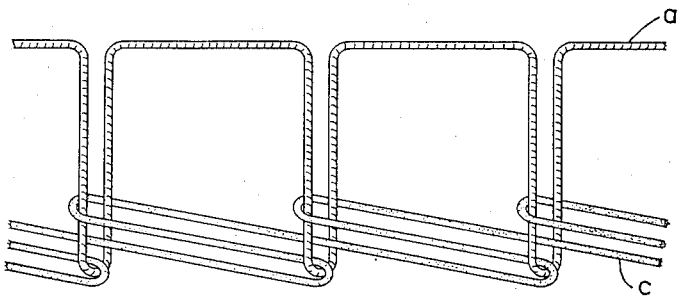
FIG. 11 shows double chain stitches as shown in FIGS. 10A to 10L.

If sewing is performed by canceling the operative connection of the upper looper 15 with the main shaft 2 by the operating lever 20 and further applying transverse movement to the lower looper 31 to cause the latter to perform combined movement including longitudinal and transverse movements, then the needle 6, lower looper 31 and threads a and c are put in action, forming double chain stitches (USA FEDERAL STANDARD 751a STITCH TYPE 401) as shown in FIG. 11.

Referring to FIGS. 10A through 10L, the order of stitch formation will now be described. These figures show the relationship between the needle 6 and the lower looper 31 and the twining of the needle thread a and the lower looper thread c. When the lower looper 31 performs the aforesaid combined movement, its front end revolves in the directions of arrows 52 and 53 (FIG. 10A) along an oval path 51 encircling the path of reciprocating movement of the needle 6. Such an oval path 51 is drawn throughout FIGS. 10A through 10L, making it possible to see the position of the lower looper 31 according to which position on the oval path 51 the front end of the lower looper 31 assumes. In addition, in FIGS. 10A through 10L, the fabric is omitted from the illustration, but the thickness of such a fabric appears as the spacing 54 between the parallel linear portions of the needle thread a and lower looper thread c.

When FIGS. 10A through 10L are viewed, the movement of the lower looper 31 will be easily understood by seeing its connection with the oval path 51. Therefore, the following description will be directed mainly to the movement of the needle 6.

Figure 10A:
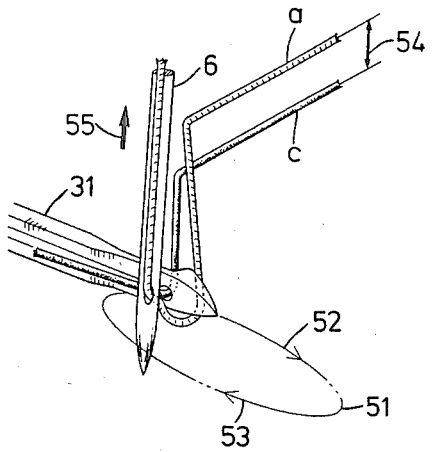
FIGS. 10A through 10L show the successive steps of forming double chain stitches (STITCH TYPE 401)

In FIG. 10A, the needle 6 is rising as indicated by arrow 55.

Figure 10D:
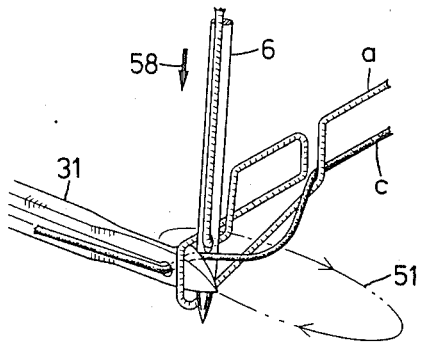
Figure 10B:
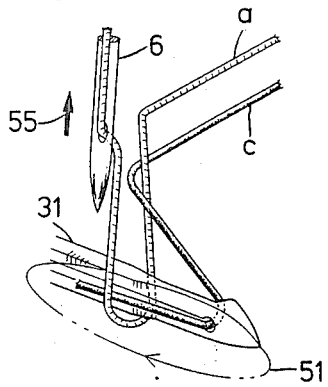

In FIG. 10B, the needle 6 is still rising as indicated by arrow 55.

Figure 10E:
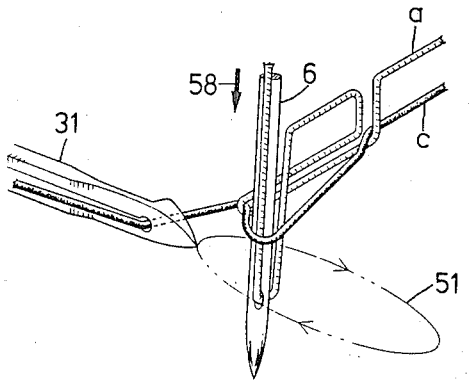
Figure 10C:
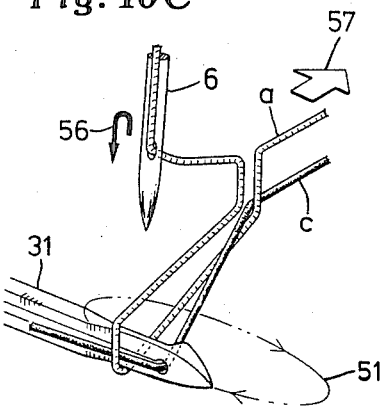

In FIG. 10C, as indicated by arrow 56, the needle 6, once reaching the top after the step shown in FIG. 10B, has begun to lower. The unillustrated fabric is fed in the direction of arrow 57 on the way from the step of FIG. 10B to the step of FIG. 10C, the feeding of the fabric ending before the next step of FIG. 10D is reached.

In FIG. 10D, the needle is lowering as indicated by arrow 58.

In FIG. 10E, the needle 6, as indicated by arrow 58, is further lowering, just before reaching its lowermost end.

Figure 10F:
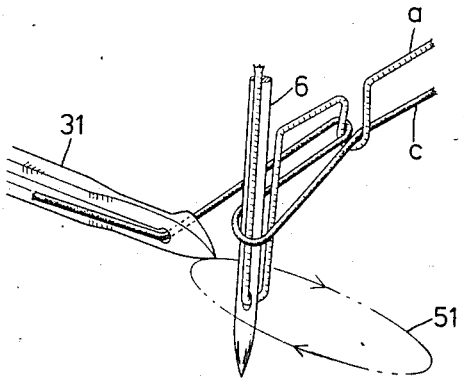
Figure 10G:
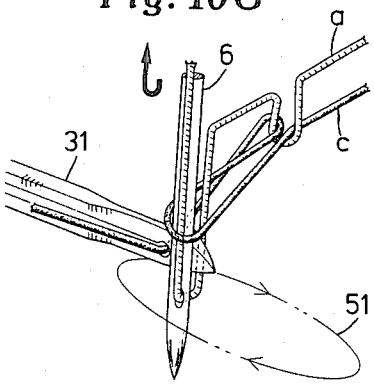
Figure 10J:
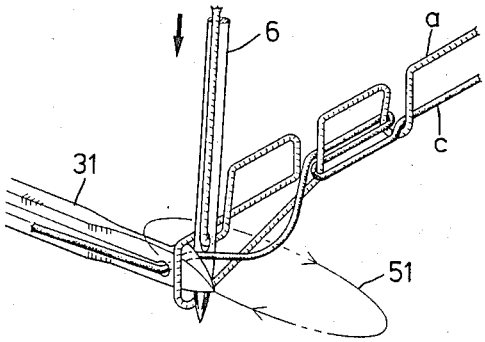
Figure 10H:
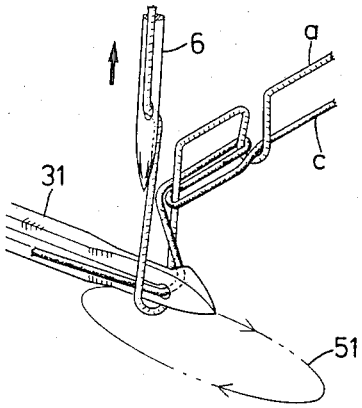
Figure 10K:
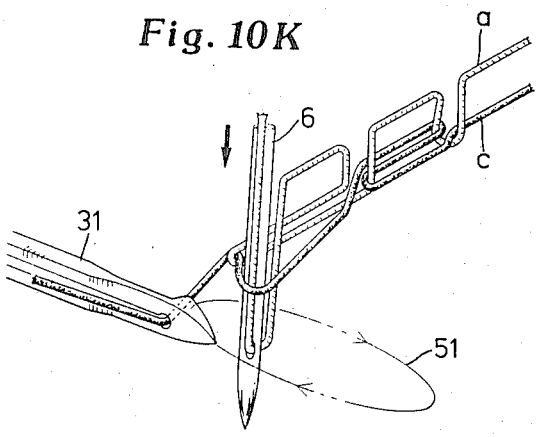
Figure 10I:
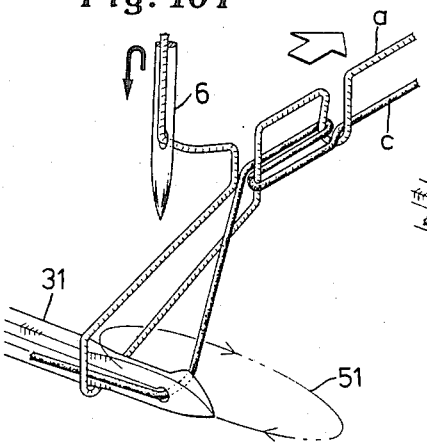
Figure 10L:
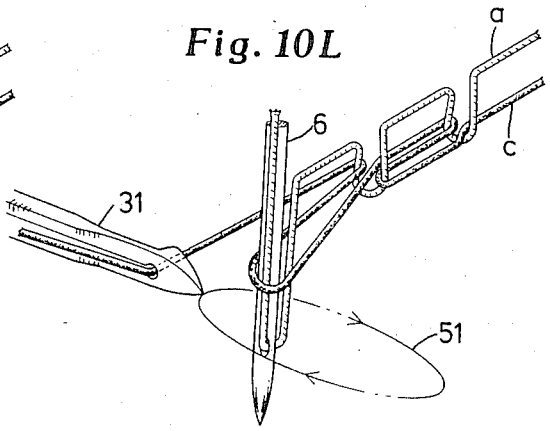

In FIG. 10F, the needle 6 has reached its lowermost position.

The steps shown in FIGS. 10G through 10L correspond to the steps shown in FIGS. 10A through 10F and correspond to the state in which stitch formation has advanced one step.

In this manner, three-thread overedge stitching and chain stitching can be selectively attained using a single sewing machine by operating the operating lever 20.

In the aforesaid embodiment, although a fabric edge cutting mechanism is not provided, sewing may be performed after the edges have been aligned. In the case where such a mechanism is installed, an arrangement is made so that the cutting mechanism will be rendered inactive during chain stitching by the known canceling mechanism disclosed in the aforesaid utility model specifications.

Figure 12:
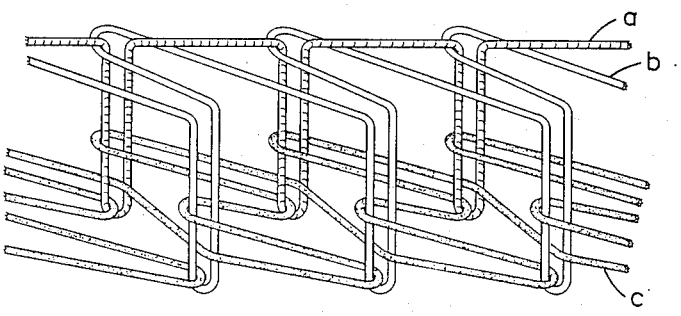
FIG. 12 shows three thread double chain overedge stitches (STITCH TYPE 601)

The above embodiment has been arranged so that the first mode in which when the upper looper is swung, transverse movement is not applied to the lower looper 31 and the second mode in which when the swing movement of the upper looper 15 is stopped, transverse movement is applied to the lower looper 31, can be selected by the operation of the common operating lever 20. In place of such an arrangement, it is possible to separately provide operating means for starting and stopping the swing movement of the upper looper 15 and means for applying or not applying combined movement to the lower looper 31. In this case, three thread double chain overedge stitches (USA FEDERAL STANDARD 751a STITCH TYPE 601) shown in FIG. 12 can be obtained by adding transverse movement to the swing movement of the lower looper 31 while operatively connecting the upper looper 15 to the main shaft 12 to swing it.

Figure 13:
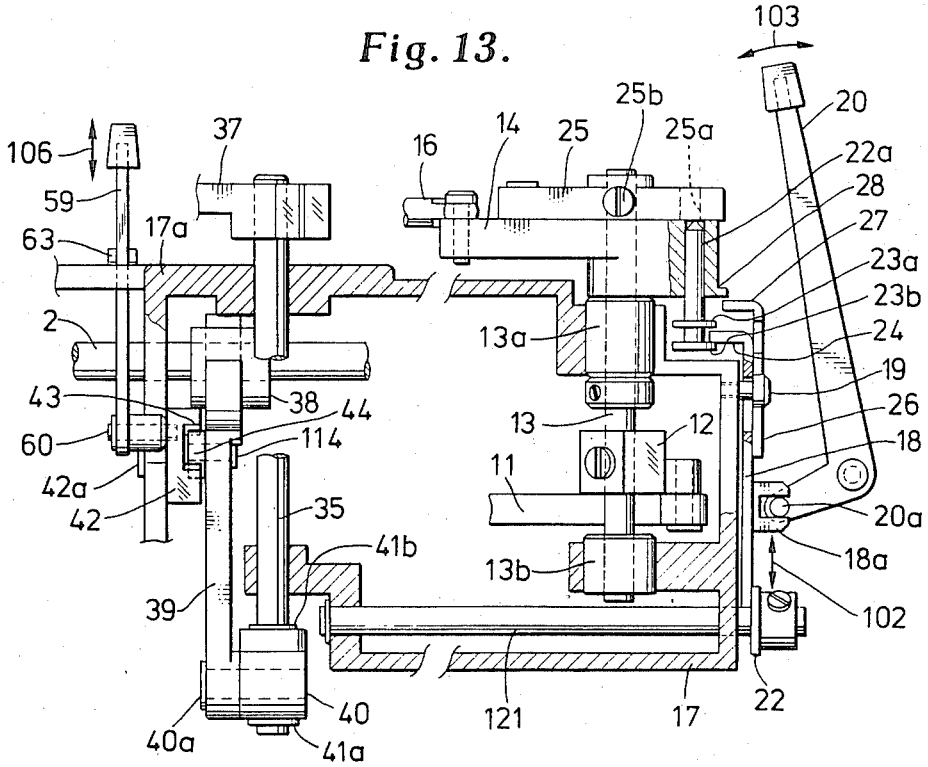
FIG. 13 is a view similar to FIG. 4, but showing the principal portion of another embodiment of the invention.
Figure 14:
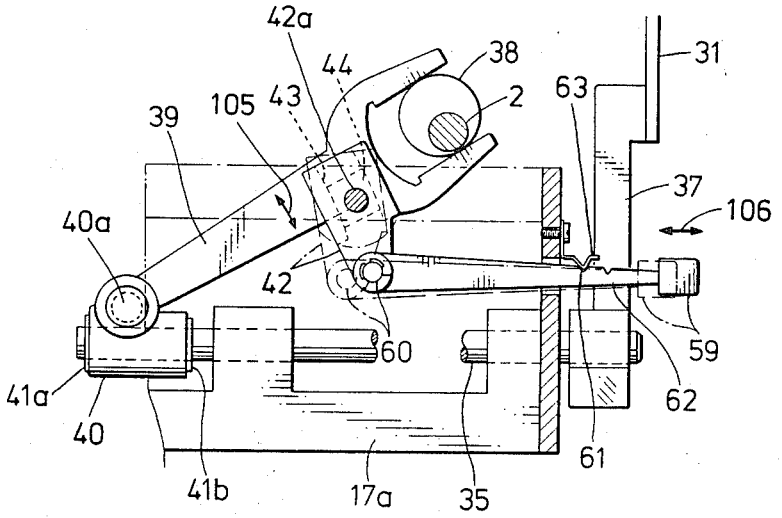
FIG. 14 is a view similar to FIGS. 5 or 6, but showing the embodiment shown in FIG. 13.

A concrete example of the arrangement for separately selecting the modes of operation of the upper and lower loopers described above will now be described with reference to FIGS. 13 and 14. FIG. 13 is a view corresponding to FIG. 4, and FIG. 14 is a view corresponding to FIGS. 5 or 6. In addition, in FIGS. 13 and 14, the parts corresponding to those shown in FIGS. 4 through 6 are indicated by the same reference characters and the same description will not be repeated.

In FIG. 13, the arrangement shown in the right half is substantially the same as that shown in FIG. 4. In FIG. 13, the operating shaft 121 in this case does not extend beyond the shaft 35. Therefore, the operation by the operating lever 20 influences only the link mechanism associated with the upper looper 15, not influencing the link mechanism associated with the lower looper 31. The operating means for selecting the operation modes of the lower looper 31 is embodied by an operating rod 59 different from the operating lever 20.

The operating rod 59, best shown in FIG. 14, has a guide member 42 connected to one end thereof through a pin 60. Thus, by pushing or pulling the operating rod 59, as indicated by arrows 106, the angle of inclination of the guide member 42 can be changed. In FIG. 14, the attitude of the guide member 42 shown in solid lines corresponds to the state shown in FIGS. 5 and 8A, while that shown in phantom lines corresponds to the state shown in FIGS. 6 and 8B. One lateral edge of the operating rod 59 is formed with two notches 61 and 62, while the frame **17*a* is provided with a plate spring 63 adapted to elastically fit in either of said notches 61 and 62. Thus, the operating rod 59 can be stably held in two states, a pushed state and a pulled state, and hence the guide member 42 can be stably held in two states in which the angle of inclination has been changed. In addition, the operating rod 59 is positioned in a position like the one shown by phantom lines in FIG. 1**, with respect to the sewing machine body A.

In each of embodiments described above, the inclination of the guide member 42 is adjusted in two stages according to whether or not transverse movement should be applied to the lower looper 31. However, the arrangement may be such that adjustment of the guide member can be made in more stages. In that case, the amount of transverse movement of the lower looper relative to the needle can be adjusted.

The mechanism for applying or not applying transverse movement to the lower looper 31 has been described as comprising the guide member 42 and block 44 in each of the embodiments described above, but such an arrangement may be replaced by the following one.

Figure 15:
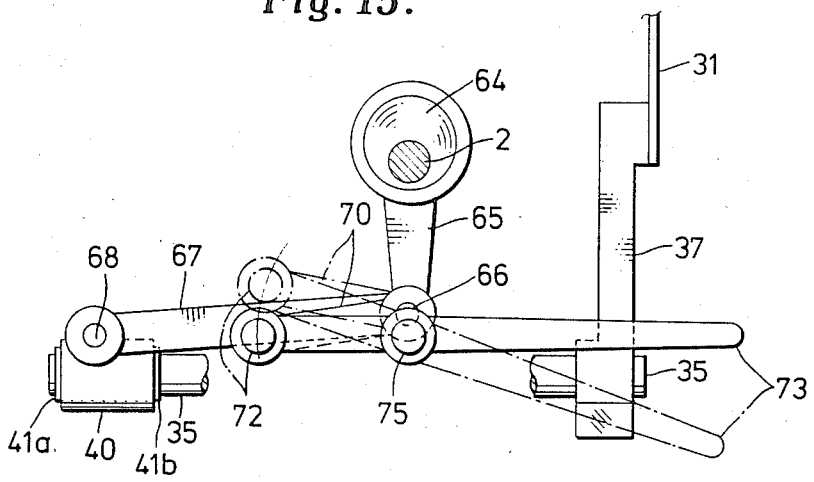
FIG. 15 is a view similar to FIGS. 5 or 6, but showing another embodiment of the invention.

FIGS. 15 through 18 show another example of a mechanism for selectively applying transverse movement to the lower looper 31. In FIG. 15, there are shown parts including a lower looper 31, lower looper block 37, shaft 35 and bearing 40, but they are substantially the same as those shown in the preceding embodiments and indicated by the same reference characters as used before.

As in the preceding embodiments, to apply transverse movement to the lower looper 31, it is only necessary to reciprocate the shaft 35 in the direction of its axis. Referring mainly to FIGS. 15 and 16, fixed on the main shaft 2 is a cam 64 on which is fitted one end of a driven rod 65. The other end of the driven rod 65 is connected to one end of lever 67 through a pin 66 so that they are turnable relative to each other. The pin 68 is fixed to the bearing 40 by a screw 69.

The pin 66 is also fitted in one end of a connecting rod 70 and fixed thereto by a screw 71. The other end of the connecting rod 70 is turnably connected to one end of an operating lever 73 by a pin 72. The pin 72 is prevented from slipping off by means of a slip-off preventive element 74. The intermediate portion of the operating lever 73 is turnably connected to the frame **17*b* of the sewing machine body by a pin 45. A spring washer 76 is interposed between the head of the pin 75 and the operating lever 73, and the pin 75 is fixed to the frame 17*b* by a screw 77. The front end of the operating lever 73** is positioned outside the sewing machine body for exposure.

Referring to FIG. 15, the operating lever 73 is turnable between the solid and phantom line positions. In response to such turning movement, the position of the pin 72 relative to the lever 67 is changed.

The state shown in FIG. 17 corresponds to the time when the operating lever 73 assumes the position shown in solid lines in FIG. 15. In this state, when the lever 67 is swung around the axis of the pin 68 through the cam 64 and driven rod 65 by the rotation of the main shaft 2, the connecting rod 70 is also swung around the axis of the pin 72. At this time, the pin 72 acts as a fixed point. Since an arc whose center is located at the pin 72 and whose radius is equal to the distance from the pin 72 to the pin 66 is approximately similar to an arc whose center is located at the pin 68 and whose radius is equal to the distance from the pin 68 to the pin 66, the position of the pin 68 remaining substantially unchanged, so that the shaft 35 does not substantially axially move. As a result, no transverse movement is applied to the lower looper 31.

On the other hand, the state shown in FIG. 18 corresponds to the time when the operating lever 73 in FIG. 15 assumes a position shown in phantom lines. In this state, the pin 72 is positioned deviated a relatively large distance from the lever 67. In this state, when the driven rod 65 is reciprocated through the cam 64 by the rotation of the main shaft 2, the arcuate path of movement of the pin 67 disposed at the end of the connecting rod 70 turning around the axis of the pin 72 which serves as a fixed point does not conform to the path of turning movement of the lever 67 around the axis of the pin 68, thus creating a deviation 78. This deviation 78 is accommodated by the displacement 79 of the pin 68, so that the shaft 35 is axially reciprocated, with the result that transverse movement is applied to the lower looper 31.

In the embodiment shown in FIGS. 15 through 18, too, by more minutely changing the angle of rotation of the operating lever, the amount of transverse movement of the lower looper 31 relative to the needle can be finely adjusted.

Although the present invention has been described and illustrated in detail, it is clearly understood that the same is by way of illustration and example only and is not to be taken by way of limitation, the scope of the present invention being limited only by the terms of the appended claims.

We claim:

1. An overedge sewing machine wherein with movements given from a main shaft which is driven for rotation, a needle is substantially vertically moved and an upper looper is substantially vertically moved in the direction which crosses the fabric feed direction and a lower looper is swung in the direction crossing the fabric feed direction, the cooperating action of said needle and said upper and lower loopers performing three thread overedge stitching, said overedge sewing machine being characterized in that it comprises:

means for selectively stopping the substantially vertical movement of said upper looper; and means for applying reciprocating movement in the fabric feed direction to said lower looper with the timing agreeing with the substantially vertical movement of said needle.

2. An overedge sewing machine as set forth in claim 1, further comprising means for selectively deactivating said means for applying reciprocating movement in the fabric feed direction to the lower looper.

3. An overedge sewing machine as set forth in claim 1, wherein said means for applying reciprocating movement in the fabric feed direction to the lower looper is given movement from said main shaft.

4. An overedge sewing machine as set forth in claim 1, wherein said means for selectively stopping the vertical movement of said upper looper comprises a connecting member given movement from the main shaft to swing, a swing member adapted to give movement to said upper looper, and a locking pin adapted to be selectively inserted in both said connecting member and said swing member to unite them together.

5. An overedge sewing machine as set forth in claim 2, further including a shaft which has said lower looper attached thereto to give said swing movement to said lower looper and which is given movement from said main shaft to be reciprocatively turned around the axis thereof, said means for applying reciprocating movement in the fabric feed direction to the lower looper including means for reciprocating said shaft axially thereof.

6. An overedge sewing machine as set forth in claim 5, wherein said means for reciprocating said shaft comprises a bearing mounted on said shaft so that it is not axially movable relative to said shaft but is allowed to turn thereon, a swing member turnably mounted on said bearing and given movement from said main shaft to swing, a block installed on said swing member and a guide member having a groove providing an arcuate path different from the path of turning movement of said swing member.

7. An overedge sewing machine as set forth in claim 6, wherein said means for selectively deactivating said means for applying reciprocating movement in the fabric feed direction comprises means for changing the inclination of said guide member, whereby the path of turning movement of said swing member substantially conforms to the arcuate path along which said groove extends.

8. An overedge sewing machine as set forth in claim 7, wherein said means for changing the inclination of said guide member comprises a turnable operating lever, and a link mechanism for transmitting the turning movement of said operating lever to said guide member.

9. An overedge sewing machine as set forth in claim 7, wherein said means for changing the inclination of said guide member comprises an operating rod adapted for substantially linear movement, and a link mechanism for transmitting the linear movement of said operating rod to said guide member.

10. An overedge sewing machine as set forth in claim 5, wherein said means for reciprocating said shaft comprises a bearing mounted on said shaft so that it is not axially movable relative to said shaft but is allowed to turn thereon, a lever turnable mounted on said bearing and given movement from said main shaft to swing, and a connecting rod turnably connected to the front end of said lever and having a center of turning movement difrerent from the center of turning movement of the lever.

11. An overedge sewing machine as set forth in claim 10, wherein said means for selectively deactivating said means for applying reciprocating movement in the fabric feed direction comprises means for changing the position of the center of turning movement of said connecting rod.

12. An overedge sewing machine as set forth in claim 11, wherein said means for changing the position of the center of turning movement comprises an operating lever for positioning said center of turning movement of said connecting rod at one end.

13. An overedge sewing machine as set forth in claim 2, further comprising means for operatively connecting said means for selectively stopping the vertical movement of said upper loop to said means for selectively stopping the reciprocating movement in the fabric feed direction of the lower looper, whereby when the vertical movement of said upper looper is stopped the reciprocating movement in the fabric feed direction is applied to the lower looper and when the reciprocating movement of the lower looper in the fabric feed direction is stopped the upper looper reciprocates substantially vertically.

14. An overedge sewing machine as set forth in claim 2, wherein said means for selectively stopping the vertical movement of said upper looper and said means for selectively stopping the reciprocating movement in the fabric feed direction of the lower looper have separate operating means.

15. An overedge sewing machine as set forth in claim 1 wherein said means for selectively stopping the vertical movement of said upper looper comprises movable operating means, and means for rendering said operating means movable only when said upper looper is in its lowermost position.

16. An overedge sewing machine as set forth in claim 15, wherein said means for rendering said operating means movable only when said upper looper is in its lowermost position comprises a projection operatively associated with the movement of said upper looper, and a malfunction preventing plate adapted to move in a unit with said operating means and having a notch at a position corresponding to the position assumed by said projection when said upper looper is in its lowermost position, whereby said malfunction preventing plate operates only in the state in which said projection is received in said notch.

* * * * *